US005918430A

United States Patent [19]

Rowland

[11] Patent Number: 5,918,430

[45] Date of Patent: Jul. 6, 1999

[54] REMOVABLE STORM SHIELD

[76] Inventor: Clark D. Rowland, 35 Lillian Ave., New Fairfield, Conn. 06812

[21] Appl. No.: 08/956,281

[22] Filed: Oct. 23, 1997

Related U.S. Application Data

[60] Provisional application No. 60/036,378, Jan. 23, 1997.

[51] Int. Cl.[6] ..... E06B 3/26

[52] U.S. Cl. ..... 52/202; 244/129.3

[58] Field of Search ..... 52/202; 244/129.3

[56] References Cited

U.S. PATENT DOCUMENTS

| | | | |
|---|---|---|---|
| 2,012,388 | 8/1935 | Goodman . | |
| 2,575,757 | 11/1951 | Hardy | 52/202 |
| 2,583,439 | 1/1952 | Oswald et al. . | |
| 2,602,970 | 7/1952 | Gouge | 244/129.3 X |
| 2,835,935 | 5/1958 | Housley . | |
| 3,317,710 | 5/1967 | Boicey et al. | 244/129.3 X |
| 3,745,704 | 7/1973 | Covington . | |
| 4,333,271 | 6/1982 | DePaolo et al. . | |
| 4,514,945 | 5/1985 | Menchetti et al. . | |
| 4,699,335 | 10/1987 | DeOms et al. | 244/129.3 |
| 5,228,238 | 7/1993 | Fenkell . | |
| 5,277,384 | 1/1994 | Webb | 294/129.3 |
| 5,457,921 | 10/1995 | Kostrzecha . | |
| 5,487,243 | 1/1996 | Hale et al. . | |
| 5,560,164 | 10/1996 | Ahrens . | |

FOREIGN PATENT DOCUMENTS

| | | | |
|---|---|---|---|
| 862325 | 3/1941 | France . | |
| 1253514 | 1/1961 | France . | |
| 1335864 | 7/1963 | France . | |
| 901987 | 1/1954 | Germany | 244/129.3 |
| 958248 | 2/1957 | Germany . | |
| 2217278 | 10/1973 | Germany . | |
| 493503 | 10/1938 | United Kingdom | 244/129.3 |
| 650882 | 3/1951 | United Kingdom . | |

*Primary Examiner*—Creighton Smith
*Attorney, Agent, or Firm*—Richard C. Litman

[57] ABSTRACT

A removable storm shield, and method of attaching a removable storm shield, to protect an opening in the wall of a building structure from damage caused as a result of foul weather conditions or other destructive acts. The storm shield includes a convex panel having a centrally located portion with a substantially singularly convex cross-section that resists exterior forces and a flat peripheral portion for stabilizing surface contact with the exterior wall, a plurality of fasteners to attach the convex panel to the wall, and a plurality of slots defined in the flat portion through which each fastener is slidably attached to the convex panel.

14 Claims, 3 Drawing Sheets

REMOVABLE STORM SHIELD

CROSS-REFERENCE TO RELATED APPLICATION

This application claims the benefit of U.S. Provisional Patent Application Ser. No. 60/036,378, filed Jan. 23, 1997.

BACKGROUND OF THE INVENTION

1. Field of the Invention

The present invention relates to a storm shield for the protection of glass or other fragile window and door structures from breakage or damage that would otherwise occur due to severe atmospheric weather conditions or due to vandals or burglars. More particularly, the present invention relates to a shield for use on homes, office buildings, and other walled structures in geographical locations where high winds, tornadoes, hurricanes, floods, or other destructive weather related phenomenon or vandalism, burglary, or similarly destructive crimes are of sufficiently frequent occurrence to require a special protective means for windows, doors, and similar openings in building structures.

2. Description of Related Art

Hurricanes, tornadoes, floods and other intense weather related phenomenon, and destructive acts of vandalism and burglary, have resulted in enormous quantities of property damage. Often, storm related damage occurs when flying debris, surging high water tides, or high winds cause windows or doors to break, thus causing further damage to the window or door structure and the interior of the building. Such damage cumulatively taxes the nation through rebuilding costs, federal, state and local disaster relief assistance programs, and rising insurance premiums. Thus homeowners, business owners, insurance companies, insurance consumers and taxpayers all share a common interest in protecting property from damage. Covering windows and doors, the weakest part of a building's exterior structure, is necessary to protect the building and the contents of the building from damage due to high winds, water, and airborne debris during severe weather conditions. Window and door coverings are similarly preventative of criminal property damage including looting and vandalism.

Moreover, a severe weather condition often strikes after a minimal passage of time from a first warning of its approach. Therefore, it is desirable to have a storm shield that can be erected in the shortest amount of time possible.

In the past, building owners commonly prepared for oncoming storms by semi-permanently boarding up their buildings with boards and nails. Subsequent to the passage of such storms, the building owner frequently caused a disfiguration of the exterior surface of the building by removing the nails from the exterior walls of the building. As a result, a number of permanently installed storm shutters for protecting windows from inclement weather were developed and are known. Moreover, various types of temporary outside shields are known; however, these are often inconvenient to carry, difficult and slow to install or disassemble, or poorly shaped to absorb a force of impact.

Additionally, when the strain of an impact or other exterior force is more than the face of a shield can absorb, the common nail and board approach, and other well-known shields, bear the strain of impact through the fasteners, which can tear free of the exterior wall and cause additional damage to that wall, the window sash or sill, or the door frame, under the strain of an impact. Likewise, structural harm to the exterior wall can be caused by thermal expansion or contraction of the shield material when the shield lacks a means to move relative to its fasteners.

Some storm shields currently known in the art contain multiple segments. Such shields require additional fasteners, and additional time to erect and disassemble. Often these shields also require overlapping members. Overlapping members increase the cost of raw material in the shield. Additional fasteners increase both the cost of materials and the time required to erect and disassemble the shield.

Exemplary of shields having the above discussed disadvantages include the following. Several patents that show hurricane shields, shutters or panels that protect a window from the exterior include U.S. Pat. No. 2,012,388, issued to W. W. Goodman on Aug. 27, 1935; U.S. Pat. No. 2,583,439, issued to Joseph H. Oswald et al. on Jan. 22, 1952; U.S. Pat. No. 2,835,935, issued to T. P. Housley on May 27, 1958; U.S. Pat. No. 3,745,704, issued to James B. Covington on May 27, 1958; U.S. Pat. No. 4,333,271, issued to James F. DePaolo et al. on Jun. 8, 1982; U.S. Pat. No. 5,457,921, issued to Gregory E. Kostrzecha on Oct. 17, 1995; U.S. Pat. No. 5,487,243, issued to Joseph F. Hale on Jan. 30, 1996; French publication Number 862,325, by M. Arthur Egle, published on Mar. 4, 1941; British publication Number 650,882, by Sven Eric Persson, published on Mar. 7, 1951; German published Patent Number 958,248, and application number 10,326, by Thomas Gregory Fegan, published on Feb. 14, 1957; French publication Number 1,253,514, by M. Eugene-Emile Chehere, published on Jan. 2, 1961; French publication Number 1,335,864, by M. Merlin John Morgan et al., published on Jul. 15, 1963; and German publication Number 2,217,278, by Hubertus Schurian et al., published on Oct. 31, 1973. Related U.S. Pat. No. 5,228,238, issued to Randall M. Fenkell on Jul. 20, 1993, shows a transparent storm shutter that covers and protects a window from the exterior.

U.S. Pat. No. 4,514,945, issued to Robert J. Menchetti on May 7, 1985, shows a window insulating panel that covers and protects a window from the interior. U.S. Pat. No. 5,560,164, issued to Robert G. Ahrens on Oct. 1, 1996, also shows an inside shield for windows that covers and protects a window from the interior.

None of the above described inventions show a shield with a substantially singularly convex cross-section or a slot in which a fastener is slidably attached, which configuration maximally absorbs and distributes forces across the face of the shield and eliminates the need for temporary fastening means potentially destructive to the building. Likewise, none of the above inventions and patents, taken either singularly or in combination, is seen to describe the instant invention as claimed. Thus a removable storm shield solving the aforementioned problems is desired.

SUMMARY OF THE INVENTION

The present invention is an exterior covering (referred to herein as a removable storm shield, storm shield, or shield), and a method for attaching the shield, to protect an opening in the wall of a building structure from impact damage. The storm shield has a convex panel comprising a centrally located portion with a substantially singularly convex cross-section for optimally resisting exterior forces and a flat peripheral portion for stabilizing surface contact with the exterior wall, a plurality of fasteners to attach the shield to the wall, and a plurality of slots directionally defined in the flat peripheral portion through which each fastener slidably passes to allow maximal deflection of the peripheral portion past the fastener in the event of an impact.

Accordingly, it is a principal object of the invention to provide a removable storm shield that is structurally resistant to an exterior force when mounted upon an opening in the wall of a building structure.

It is another object of the invention to improve the ease and convenience with which a user can transport the convex panel by reducing the material thickness, and thus the material weight, necessary to achieve the same resistance to an exterior force present in a panel composed primarily of planar, not substantially singularly convex cross-sectional, surfaces.

Still another object of the invention is to provide resistance to an exterior force greater than the resistance of a shield composed primarily of planar material surfaces, in a convex panel of substantially singularly convex cross-section composed of the same amount of material in the same thickness as a shield with primarily planar material surfaces.

Another primary object of the invention is to provide a fastening means which minimize the risk of tearing free of its moorings when the strain of an impact is more than the face of a shield can absorb.

A further object of the invention is to avoid damage to the exterior wall of the building or to the sash, sill, or frame of a window or door caused by thermal expansion or contraction of the shield.

Yet another object of the invention is to provide a storm shield that can be quickly, easily, and inexpensively erected and removed without resorting to skilled labor, or making significant structural modifications to a dwelling.

A related object of the invention is to provide a shield that can be erected and disassembled quickly and with less effort by minimizing the number of fasteners required, and by lowering total material cost and weight by optimizing the shield configuration.

It is an object of the invention to provide improved elements and arrangements thereof in a removable storm shield for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is directed to an exterior covering that protects an opening in the wall of a building structure from damage. For the purpose of promoting an understanding of the principles of the invention, a discrete number of specific embodiments are described herein as exemplary of such principles.

Figure 1:
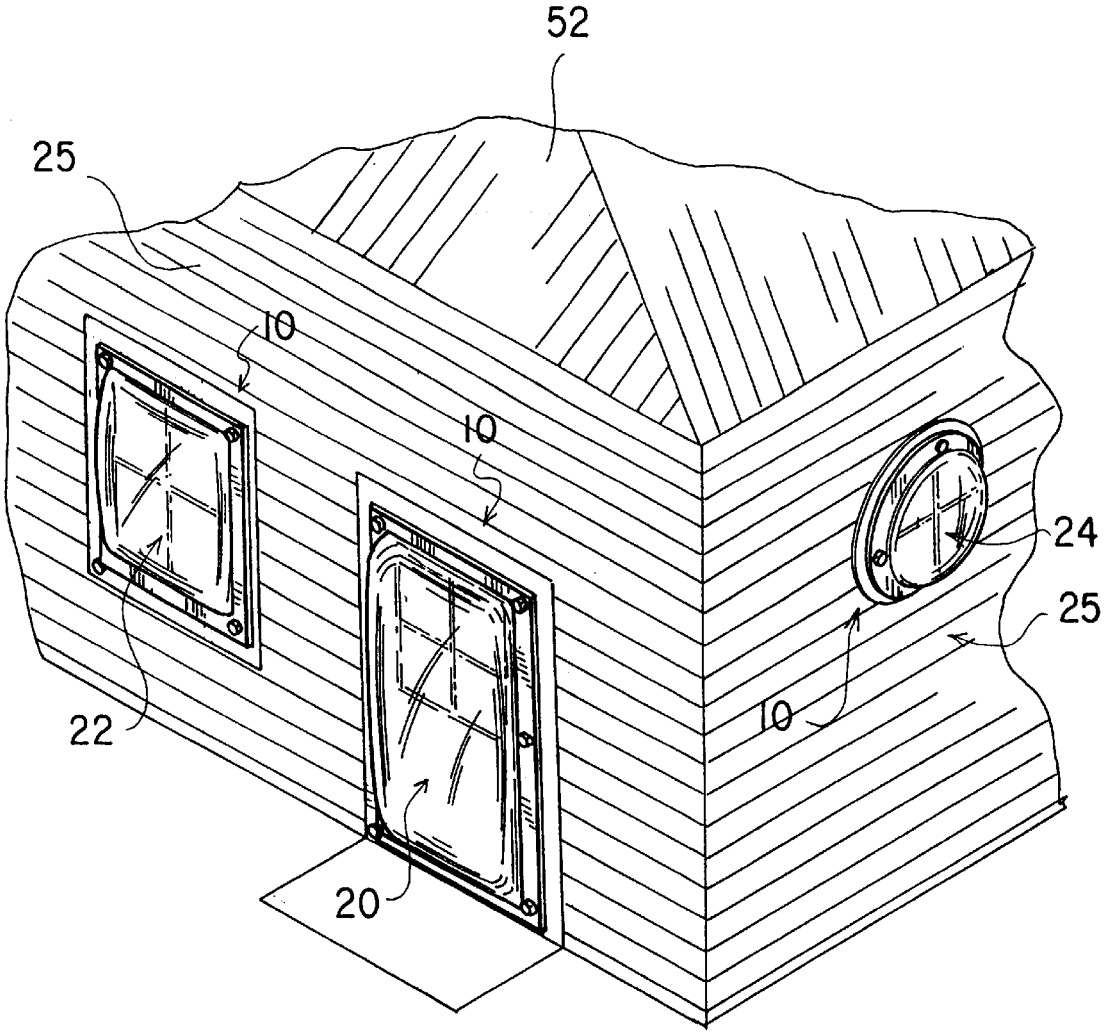
FIG. 1 is an environmental, perspective view showing a rectangular storm shield removably mounted over a window, a rectangular storm shield removably mounted over a door, and a circular storm shield removably mounted over a window according to the present invention.

Referring first to FIG. 1, a removable storm shield 10 is shown covering an opening 43 in the exterior walls 25 of a building structure 52. The openings 43 are hidden behind the shields 10 in FIG. 1, but described in greater detail herein. A rectangular convex panel 20 is shown covering a doorway, a square convex panel 22 is shown covering a standard window, and a circular convex panel 24 is shown covering a round bathroom window.

Collectively, the standard window, the doorway, and the bathroom window exemplify a typical opening 43 in the exterior wall 25 of a building 52. Because many windows are rectangular, the rectangular convex panel 20 could also be used to cover a window as well as the doorway shown. In addition to these three shapes, the storm shield's convex panel could be made in many other shapes, e.g. a semi-circle or a quarter circle, consistent with the principles described herein. Collectively, all possible shapes of the convex panel will be referred to below by specific reference to the three embodiments shown in FIG. 1. Thus, it should be understood that references herein to the convex panel 20–24 are not limited in shape to the rectangular convex panel 20, the square convex panel 22, and the circular convex panel 24 shown.

As a general physical principle for any given material of predetermined thickness, a single curvilinear, convex shape, thus defining a substantially singularly convex shape, provides greater structural resistance to opposing forces than a design of the same material that contains primarily planar surfaces. The present invention employs this structural preference, a substantially singularly convex shape, to distribute any given opposing force rather evenly along the entire convexity.

The substantially singularly convex shape is critical to the present invention, as it is distinguished from a shape wherein multiple convexities are used across a structure, and from the case where a curvilinear convexity is simulated by a series of planar surfaces. Where multiple convexities are used, any given force is distributed only along the portion of the material contained in that convex surface, not along the entire structure. This provides less total material resistance to the force. Where planar surfaces are used to simulate a convex shape, forces are not distributed as evenly along the material. Rather, certain portions of the planar material will bear a disproportionately large share of the burden in opposing a force. As is true with multiple convexities, a design simulating a convex shape with primarily planar surfaces also decreases the overall structural strength of the material in resisting opposing forces.

Moreover, the degree to which the material of the present shield will withstand an exterior force is defined by the impact resistance of that material. One standard by which impact resistance is measured is known as the SBCCI Standard for Windborne Debris Impact Test (SSTD 11-93). The SBCCI Standard is satisfied if a shield can withstand an impact from a 97" length of 2[|m]K by 4" lumber propelled through the air at a velocity of 50 feet per second along the longitudinal axis of the length of lumber. In other words, the lumber used for an impact test under the SBCCI Standard is propelled through the air along its 97" length so that only a 2" by 4" surface portion at one end of the length of lumber impacts the structure being tested.

It should be understood that, although this standard has been considered for inclusion in the South Florida Building Code, it is not the only reasonable way that impact resistance can be quantified for the purpose of enabling an understanding of the present invention. The present invention employs both the singularly convex shape and a high impact resistant material.

Figure 2:
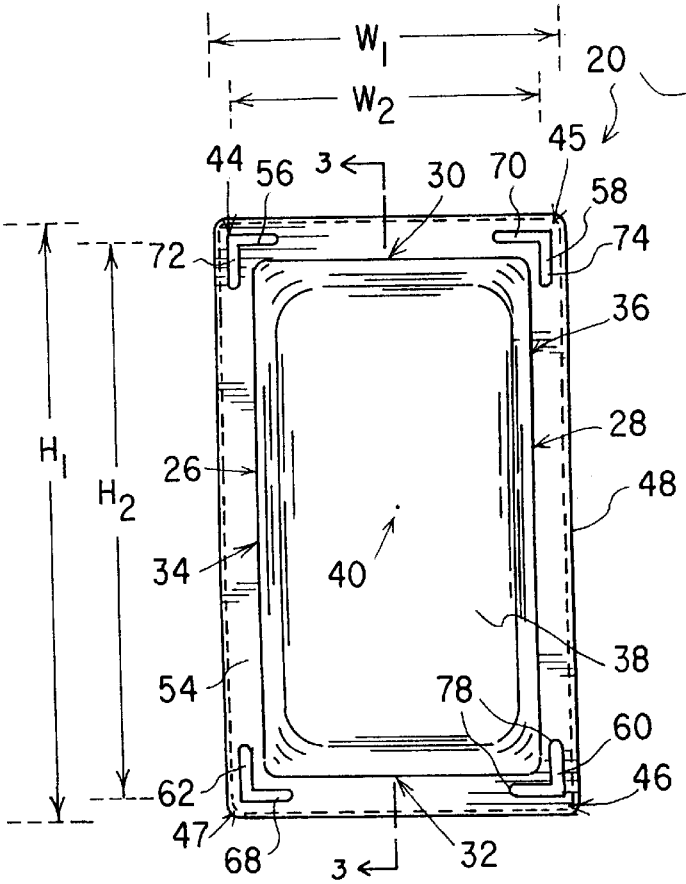
FIG. 2 provides a frontal view of a first embodiment of a storm shield according to the present invention, showing a rectangular convex panel with L-shaped slots.
Figure 3:
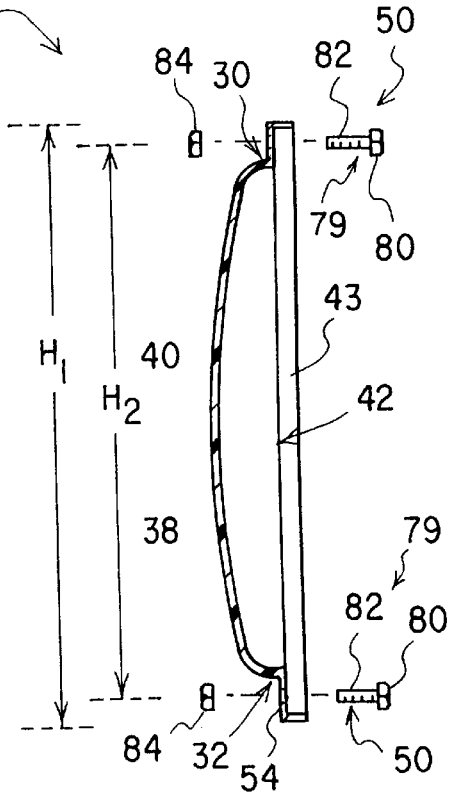
FIG. 3 provides a cross-sectional view of a removable storm shield according to the present invention as shown along line 3—3 of FIG. 2.

Referring now to FIGS. 2 and 3, the substantially singularly convex longitudinal-section is illustrated between points 30 and 32. In this embodiment, the cross-section between points 26 and 28 is similarly substantially singularly convex, as is the section between points 34 and 36. The sections formed between points 32 and 26, points 34 and 30, 34 and 28, and 32 and 28 are also all substantially singularly convex. All of these sections resemble the longitudinal-section pictured in FIG. 3. between points 32 and 30. Although a shape that has any one substantially singularly convex section will embody the spirit of this invention, the preferred embodiment is substantially singularly convex along all sections, thus defining a dome portion. The central portion of the convex panel 20 between points 26–36 defines the convex portion 38. The convex portion 38 of the embodiment shown in FIGS. 2 and 3 depicts a dome portion.

The substantially singularly convex portion 38 also enables additional absorption of energy by deflection of the convex portion 38. A material for its construction is chosen not only for its impact resistance, but also for its resiliency, such that it will bend before it breaks. By shaping the convex panels 20–24 to have a convex portion 38, energy from an exterior force will be optimally resisted due to the structural shape of the convex panel 20–24 and dissipated by inward deflection of the convex portion 38, i.e. flattening the convexity.

This principle can be best understood from FIG. 3, which shows a central point 42 on the surface of a window, door, or other opening 43 on the exterior wall 25 of a building structure 52 directly beneath the center point 40 of the convex portion 38. By choosing a suitable flexibly resilient material, the convex portion 38 deflects until center point 40 reaches central point 42 without coming into contact with the opening 43. Complete deflection occurs when center point 40 is deflected to central point 42. Thus, by manufacturing the convex panels 20–24 of a material that will bend before it breaks, and shaping the convex panel 20–24 to have a convex portion 38, energy from an exterior force will be absorbed not only due to the structural shape of the shield 10, but also by inward deflection of the convex portion 38 in resistance to the exterior force.

The preferred choice of material depends largely upon the maximum forces reached by severe weather conditions. Hurricane winds are, by definition, sustained above 75 miles per hour. Hurricane winds can reach in excess of 150 miles per hour. Tornado winds, though more localized than the winds of a hurricane or tropical storm, are even stronger. Though less frequent than hurricanes or tropical storms, tidal waves also occasionally strike coastal areas, propelling water even further inland than the surging high tides of a hurricane or tropical storm. Openings 43 in the exterior wall 25 of a building structure 52 that are struck by a surging high tide or a tidal wave are generally damaged by the exterior force caused by that water pressure. Suitable materials capable of withstanding such forces include well known metals and plastics of various types from the prior art, including, but not limited to, ABS, Polystyrene, Lexan, Acrylic, Polycarbonate, aluminum, galvanized steel, stainless steel, or the like. Such materials can be rated according to the SBCCI Standard to choose a predetermined impact resistance which cooperates with the convex configuration of the shield as desired.

Figure 4:
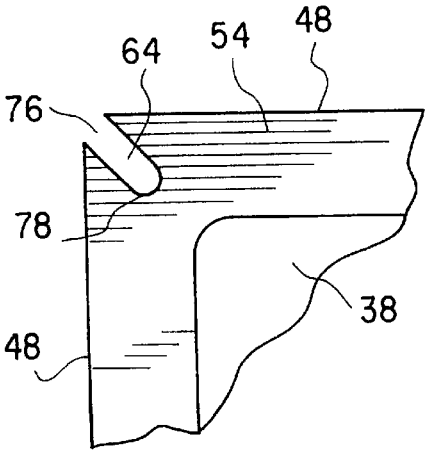
FIG. 4 provides an enlarged, fragmented view of a second embodiment of a storm shield according to the present invention, showing the corner of a square convex panel with an open ended slot angled toward the center of the convex panel.
Figure 5:
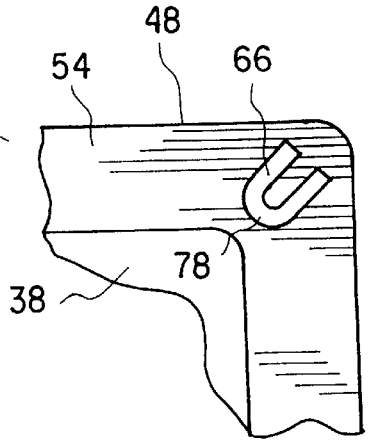
FIG. 5 provides an enlarged, fragmented view of a third embodiment of a storm shield according to the present invention, showing the corner of a square convex panel with a U-shaped slot angled toward the center of the convex panel.

In order to reduce or eliminate the problem of additional strain being borne by the fasteners 50, this invention further incorporates the use of slots 56–66 for the fasteners 50. FIG. 2 shows four L-shaped slots 56–62. FIG. 4 shows an open ended slot 64 angled towards the center of a square convex panel 22. FIG. 5 shows a U-shaped slot 66 angled towards the center 40 of a square convex panel 22. Another conceived embodiment of the shield 10 contains I-shaped slots similar to the slot 64 shown in FIG. 4, but not open ended.

The shield 10 also includes a number of different fasteners 50. The fasteners 50 of the preferred embodiment include a bolt 79 that has a threaded shank 82 and an enlarged head 80 for preventing passage of the head 80 through the slot 56–66. Two uses of this preferred fastener 50 are described.

Figure 6:
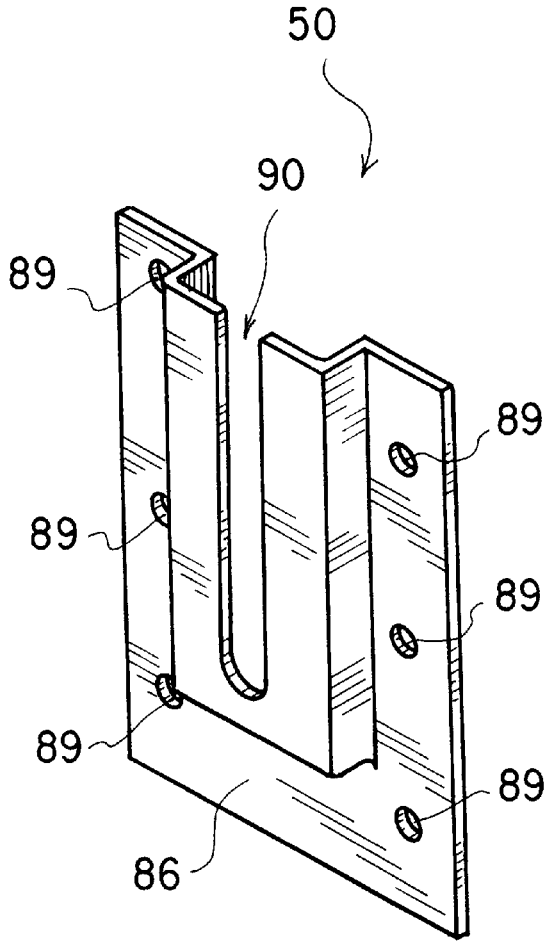
FIG. 6 is an enlarged scale perspective view of a clamp used with the invention.
Figure 7:
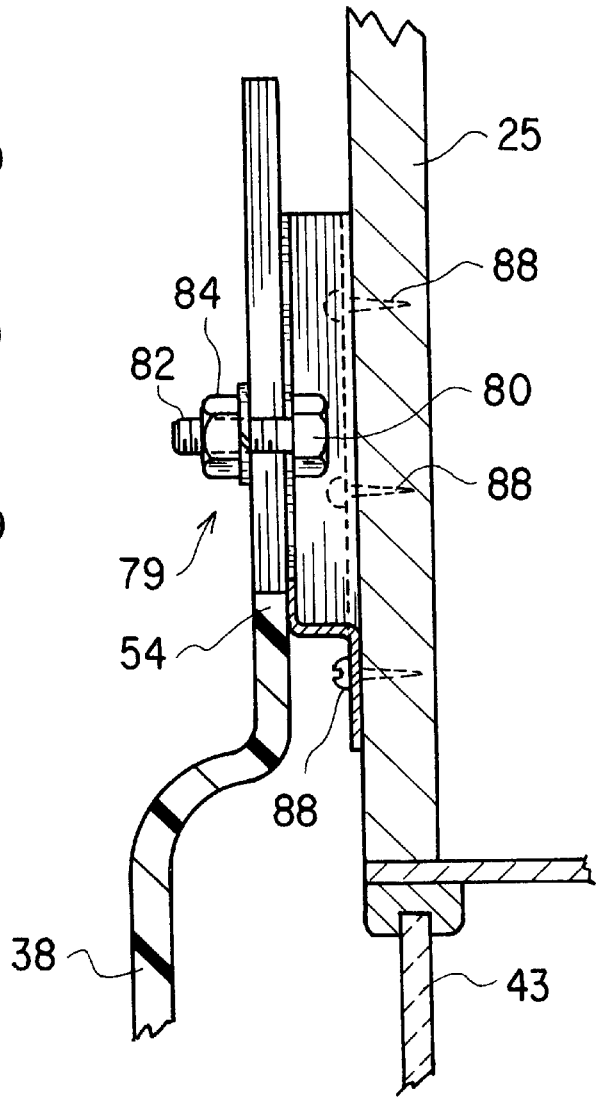
FIG. 7 is a cross-sectional view of the clamp of FIG. 6 in assembly with the rest of the invention.

The type of fastener 50 preferred for most applications uses a common cad-plated steel clamp 86, shown in FIG. 6, a bolt 79, and a nut 84, thereby defining the clamp approach. When using the clamp approach, the bolt 79 should be permanently mounted through the exterior wall 25 of the building structure 52 proximate to an opening 43 in a manner such that the clamps are aligned with the slots 56–66 in the convex panels 20–24 as shown in FIG. 7.

Typically in the clamp approach, the clamp 86 will be permanently mounted to the exterior wall 25 of the building structure 52 using a plurality of screws 88 passing through screw holes 89. The preferred clamp 86 in the clamp approach contains a clamp slot 90. The clamp slot 90 is an open ended, elevated, I-shaped slot in the clamp 86. The preferred permanent installation of the preferred clamp 86 in the clamp approach should either have the open end at the top with the clamp slot 90 extending down from the open end, thereby defining a vertical installation, or have the open end at the left or the right with the clamp slot 90 extending sideways from the open end, thereby defining a horizontal installation. A cross section of the clamp 86 in the vertical installation and a longitudinal section of the clamp 86 in the horizontal installation both appear as shown in FIG. 7.

When the custodian of a building structure 52 desires to erect one of the convex panels 20–24, a bolt 79 is slid into each clamp slot 90 with the head 80 inside the clamp slot 90 proximate the exterior wall 25 and the threaded shank 82 distal from the exterior wall 25 as shown. Once each bolt 79 is thus inserted into each clamp 86, the convex panels 20–24 are placed over each clamp 86 until the threaded shank 82 of each bolt 79 passes through the slots 56–66 in the convex panels 20–24. Nuts 84 are then screwed onto the threaded shank 82 and tightened until the convex panels 20–24 are snug against the clamp 86, yet able to move slidably by its slots 56–66 relative to the fasteners 50.

The type of fastener 50 preferred for applications where the exterior wall 25 of the building structure 52 is made of concrete block uses a long common lag bolt (not shown) and a nut 84. The head 80 of the lag bolt is permanently embedded in the exterior wall 25 of the building structure 52 proximate to an opening 43 with the threaded shank 82 of the lag bolt protruding from the exterior wall 25 in a manner such that the threaded shanks 82 are aligned with the slots 56–66 in the convex panel 20–24. Thus passage of the head 80 through the slot 56–66 is further prevented.

The flat portion 54 is then placed over each threaded shank 82 until the threaded shank 82 of each lag bolt passes through an associated slot 56–66. A nut 84 is then screwed onto the threaded shank 82 and tightened until the convex panel 20–24 is snug against the exterior wall 25 of the building structure 52, yet able to move slidably by its slots relative to the fasteners 50.

A third approach is preferred for applications where the exterior wall 25 of the building structure 52 is wood. A plurality of known helicoil inserts and a plurality of mating screws 88 are used. The helicoil insert is permanently imbedded in the exterior wall 25 of the building structure 52 proximate to an opening 43, positioned in registry with the slots 56–66 in the convex panel 20–24.

A convex panel 20–24 is then placed over the opening 43 in the exterior wall 25 of the building structure 52. Next, the screws 88 are inserted into the helicoil inserts through the slots 56–66 in the convex panel 20–24 and tightened until the convex panel 20–24 is snug against the exterior wall 25 of the building structure 52, yet able to move slidably by its slots 56–66 relative to the fasteners 50.

When an exterior force exceeds the structural ability of the convex portion 38 to resist, the perimeter 48 of the convex panel 20 will seek to expand outwardly. By tightening the fastener 50 in a slot 56–66 such that the fastener 50 may move slidably in relation to the slot 56–66, the perimeter of the convex panel 20–24 is permitted to expand outwardly. When the convex portion 38 deflects as described above, the slots 56–66 will slide relative to the fasteners 50. Complete deflection occurs when center point 40 is deflected to central point 42, as previously detailed. When complete deflection occurs, the fastener 50 will be positioned in a slot 56–66 at a point relative to the flat portion 54 most proximate to the center 40. If a slot 56–66 is too short, then the inward end of the slot 78 will come into contact with the fastener 50. As the convex panel 20–24 continues to deflect from this point, pressure will build up on the fastener 50 from the end of the slot 78, thus engaging the fastener 50 by pressure from the inward end of the slot 78.

Thus, as maximum limits are reached, the fasteners 50 could begin to tear free of the exterior wall 25 or the convex panel material could break or shatter, thus defeating the functional purpose of providing the slots 56–66. Therefore, it is desirable to engineer the slots 56–66 to a predetermined length which permits the complete deflection of the convex portion 38 without engaging the fasteners 50 by pressure from the end 78 of the slots 56–66, as determined by maximum predetermined expected forces. Properly engineered slots 56–66 likewise protect the exterior wall 25 of a building structure 52 from damage caused due to thermal expansion or contraction of the material from which the convex panel 20–24 is fabricated.

Referring to FIG. 2, L-shaped slots 56–62 are pictured. L-shaped slots 56–62 have horizontal members 68–70 and vertical members 72–74. The combination of horizontal members 68–70 and vertical members 72–74 in L-shaped slots 56–62 permits the fasteners 50 to slide either laterally or horizontally. When used in combination with the clamp 86 and bolt 79 type of fastener 50 described above, the L-shaped slot design 56–62 allows selectively installing the clamp 86 either horizontally or vertically, whichever is more convenient. When all of the slots 56–66 in the convex panel 20–24 are L-shaped 56–62, then any combination of horizontal and vertical installation of the clamps 86 may be used, whatever is most convenient.

Another conceived embodiment of the shield, not pictured, has I-shaped slots. To envision I-shaped slots, the slots 56–62 shown in FIG. 2 would lack their horizontal members 68–70, consisting only of their vertical members 72–74. If a convex panel 20–24 with I-shaped slots were used in combination with the clamp 86 and bolt 79 type of fasteners 50, then the clamps 86 would have to be installed vertically.

Expansion of the convex panel 20–24 due to an exterior force or thermal expansion will most likely take place concentrically from the center of the convex panel 40 extending radially outward. By aligning the axis of the slot 64 with the direction of such force, friction between the fastener 50 and the slot 64 will be minimized. Therefore, and referring now to FIG. 4, an open ended slot 64 angled towards the center 40 of a square convex panel 22 is pictured, to correspond with a direction transverse to such concentric expansion. A convex panel 20–24 of this embodiment is secure despite the open end 76 in the slots 56 because any slidable motion of a fastener 50 towards the open end 76 of a slot 56–66 will result in slidable motion of the opposing fastener 50 towards the inner end 78 of the opposing slot 56–66, and because the horizontal and vertical dimensions of the convex panel 20–24 between points $W_1$ and $H_1$, respectively, both exceed the horizontal and vertical distance between the fasteners, $W_2$ and $H_2$, respectively.

In the embodiment with the square convex panel 22, the axis of the slot shown in FIG. 4 is set at a forty-five degree angle to the perimeter edges 48 of the convex panel 22. If open ended slots 64 were pictured angled towards the center 40 of a rectangular convex panel 20, then the axis of the slot 64 would form an angle more obtuse relative to the edge forming the width of the convex panel 20 than to the edge forming the length of the convex panel 20.

The advantage of open ended slots 64 angled toward the center 40 of the convex panel 20–24 includes slidable motion of the fasteners 50 relative to the slots 64 with minimal frictional resistance. Furthermore, leaving an open end 76 in the slots will facilitate installation and removal of the fasteners 50. This will reduce the amount of time necessary to install and remove the storm shield 10.

Referring to FIG. 5, a U-shaped slot 66 angled towards the center of a square convex panel 22 is shown. It is believed that a U-shaped slot 66 will increase the number of directions in which the fasteners 50 of a shield may move in response to varying vectors of forces where such forces are present in application.

Referring again to FIG. 2, a flat surface 54 is shown extending from the edge 26–36 of the convex portion 38 to the edge of the convex panel 20 around its full perimeter 48. Without the flat surface 54, the convex portion 38 would be in contact with the surface of the exterior wall 25 of the building structure 52 only on its edges. The flat surface 54 greatly increases the surface contact between the convex panel and the exterior wall 25 of a building structure 52. For any given exterior force, this increased surface contact significantly decreases the pounds per square inch of force applied between the convex panel 20–24 and the exterior wall 25 of a building structure 52. The lower the pounds per square inch of force applied to the exterior wall 25 of a building structure 52, the less likely it is that the structural stability or the surface finish of that building 52 will be damaged.

In addition to the functional advantages of the flat surface 54 already specified, it is also necessary to provide a flat surface 54 in order to achieve the functional aspects of the slots 56–66 as described above. If the fasteners 50 are tightened too loosely, the convex panel 20–24 will not be snugly secured to the exterior wall 25 of the building structure 52, allowing the convex panel 20–24 to vibrate in the wind. In order to insure that the convex panel 20–24 does not damage the finish of the exterior wall 25 from vibration, the fasteners 50 should be tightened until snug contact is achieved between the convex panel 20–24 and the fasteners 50. While snugly securing the convex panel 20–24 in this manner, care should be taken to insure that the fasteners 50 will move slidably in the slots 56–66. If the fasteners 50 are tightened too securely, then the functional purpose of the slots 56–66, as detailed above, can be defeated.

The preferred method by which the convex panel 20–24 is attached to the exterior walls 25 of the building structure 52 consists of four steps. However, when a plurality of convex panels 20–24 are not installed, the plural convex panels 20–24 may be stacked in a garage, a basement, a storage room, or a storage shed. Another conceived use of a plurality of the convex panels 20–24 when not installed over an opening 43 involves a process by which square convex panels 22 or rectangular convex panels 20, or both, are themselves erected as the structural walls forming a temporary shed. In this conceived use, the shed formed by square convex panels 22, or rectangular convex panels 20, or both, would be disassembled in order to erect the convex panels 20–24 on the exterior wall 25 of the building structure 52.

In the first step of the preferred method for the intended protective use of the shields 10, clamps 50 are permanently attached to the exterior wall 25 of a building structure 52 proximate to an opening 43 such as a window or a door by screwing the plurality of screws 88 through the screw holes 89 in the clamps 86. Each clamp 86 is installed in a manner such that they will align with the slots 56–66 of a convex panel 20–24 when that convex panel 20–24 is installed. These clamps 86 become a semi-permanent part of the exterior wall 25 of the building structure 52.

The second step in the preferred method is to attach a fastener 50 to each of the clamps 86 that are permanently attached to the exterior wall 25 of the building structure 52 proximate to an opening 43 in the first step. When the person charged with caring for a building structure 52 becomes aware that a hurricane, tornado, tropical storm, or other weather related condition from which the building structure 52 should be protected is approaching, then that individual installs the convex panel 20–24 upon the permanently attached clamps 86 by attaching fasteners 50 to the clamps 86. As mentioned above, in the preferred embodiment, the convex panel 20–24 is attached to the clamps 86 with nuts 84 and bolts 79. To protect the building structure 52 from a destructive act, the caretaker may wish to install a storm shield 10 as a protective device during a period when the building structure 52 is unattended.

The third step is to install the convex panel 20–24 onto the fasteners 50 by the slots 56–66. The fourth step is to tighten the fasteners 50 until the convex panel 20–24 is snugly secured to the clamps 86 while insuring, at the same time, that the fasteners 50 are loose enough to permit slidable movement of the convex panel 20–24 relative to the fasteners 50 by the slots 56–66.

The units and quantitative measurements described herein are for illustrative purposes only. The convex panels 20–24 can be constructed to a wide variety of sizes according to specific application to each type of door or window shape and size. While the invention most commonly will be used for protecting windows on a private, residential home, the invention is equally suitable for protecting other types of openings 43 and other types of building structures 52. The shields 10 can be used for protecting any opening 43 to a building structure 52 including, but not limited to, a doorway, archway, or window. The shields 10 can be used on any type of building structure 52 including, but not limited to, residential homes, commercial and municipal buildings, sheds, beach homes, etc. It is to be understood that the present invention is not limited to the embodiments described above, but encompasses any and all embodiments within the scope of the following claims.

I claim:

1. A removable storm shield for temporarily mounting to an exterior wall of a building structure proximate to an opening in the building structure, said storm shield comprising:

a convex panel having a convex portion being substantially singularly convex defining a dome, and a flat portion extending from the perimeter of said convex portion in a single plane at an obtuse angle;

said flat portion defining a plurality of slots for receiving a plurality of fasteners for slidably mounting the convex panel to an exterior wall of a building structure proximate to an opening in the building structure;

said slots have a predetermined length to permit slidable movement of the convex panel relative to the fasteners, thereby allowing deflection of an object upon impact with the convex portion; and wherein said convex panel is made of a material having the structural characteristic of resisting predetermined destructive forces and being resilient.

2. The removable storm shield according to claim 1, the convex portion of the material being semi-rigid having the characteristic of bowing resiliently in response to exterior forces that exceed a predetermined threshold.

3. The removable storm shield according to claim 1 wherein an impact from a 97" length of 2" by 4" lumber propelled at 25 feet per second along a longitudinal axis of the length of lumber will not break the material of the convex panel.

4. The removable storm shield according to claim 1 wherein an impact from a 97" length of 2" by 4" lumber propelled at 50 feet per second along a longitudinal axis of the length of lumber will not break the material of the convex panel.

5. The removable storm shield according to claim 2 wherein an impact from a 97" length of 2" by 4" lumber propelled at 25 feet per second along a longitudinal axis of the length of lumber will not break the material of the convex panel.

6. The removable storm shield according to claim 2 wherein an impact from a 97" length of 2" by 4" lumber propelled at 50 feet per second along a longitudinal axis of the length of lumber will not break the material of the convex panel.

7. The removable storm shield according to claim 1 wherein the convex portion is convex across a transverse cross-section.

8. The removable storm shield according to claim 1 wherein the convex portion is convex along a longitudinal-section.

9. The removable storm shield according to claim 1 wherein the material is transparent.

10. The removable storm shield according to claim 1 wherein the material is selected from the group consisting of ABS, Polystyrene, Lexan, Acrylic, Polycarbonate, aluminum, galvanized steel, and stainless steel.

11. The removable storm shield according to claim 1 wherein the shape of the plurality of slots is selected from the group consisting of L-shaped, I-shaped, and U-shaped.

12. The removable storm shield according to claim 1 wherein the plurality of slots are open ended.

13. The removable storm shield according to claim 12 wherein the plurality of slots are aligned towards the center of the convex panel.

14. The removable storm shield according to claim 1 wherein the shape of the convex panel is selected from the group consisting of rectangular, circular, square, semi-circular, and a quarter circle.

* * * * *